US010935331B2

(12) United States Patent
Pereira et al.

(10) Patent No.: US 10,935,331 B2
(45) Date of Patent: Mar. 2, 2021

(54) DEVICE FOR ASSEMBLING A HEAT EXCHANGER OF AN AIR-CONDITIONING APPARATUS WITH A RADIATOR FOR COOLING THE ENGINE OF A MOTOR VEHICLE

(71) Applicant: Valeo Systemes Thermiques, Le Mesnil Saint Denis (FR)

(72) Inventors: Daniel Pereira, Le Mesnil Saint-Denis (FR); Fernando Pereira, Le Mesnil Saint-Denis (FR); Dinh-Luyen Nguyen, Le Mesnil Saint Denis (FR); Nathalie Girard, Le Mesnil Saint-Denis (FR); Karim Arab, Le Mesnil Saint-Denis (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 236 days.

(21) Appl. No.: 16/075,850

(22) PCT Filed: Feb. 7, 2017

(86) PCT No.: PCT/FR2017/050279
§ 371 (c)(1),
(2) Date: Aug. 6, 2018

(87) PCT Pub. No.: WO2017/187031
PCT Pub. Date: Nov. 2, 2017

(65) Prior Publication Data

US 2019/0041141 A1 Feb. 7, 2019

(30) Foreign Application Priority Data

Feb. 5, 2016 (FR) ..... 1650940

(51) Int. Cl.
*F28F 9/00* (2006.01)
*F28D 1/04* (2006.01)
(Continued)

(52) U.S. Cl.
CPC ..... *F28F 9/002* (2013.01); *F28D 1/0435* (2013.01); *F28F 9/005* (2013.01); *F28F 9/0075* (2013.01);
(Continued)

(58) Field of Classification Search
CPC ..... F28F 9/002; F28F 9/005; F28F 9/0075; F28F 9/266; F28F 9/007; F28F 9/26;
(Continued)

(56) References Cited

U.S. PATENT DOCUMENTS 6,059,019 A * 5/2000 Brost ..... F01P 3/18 123/41.51
6,158,500 A * 12/2000 Heine ..... B60K 11/04 165/140
(Continued)

FOREIGN PATENT DOCUMENTS

CN 1891519 A 1/2007
DE 103 47 136 A1 4/2004
FR 2 779 221 A1 12/1999

OTHER PUBLICATIONS

International Search Report issued in PCT/FR2017/050279 dated Sep. 27, 2017 (2 pages).
(Continued)

*Primary Examiner* — Tho V Duong
(74) *Attorney, Agent, or Firm* — Osha Bergman Watanabe & Burton

(57) ABSTRACT

The present invention consists in a thermal module (1) for a motor vehicle, comprising a main radiator (2) and at least one auxiliary heat exchanger (3, 4) mounted on the main
(Continued)

Figure 2:
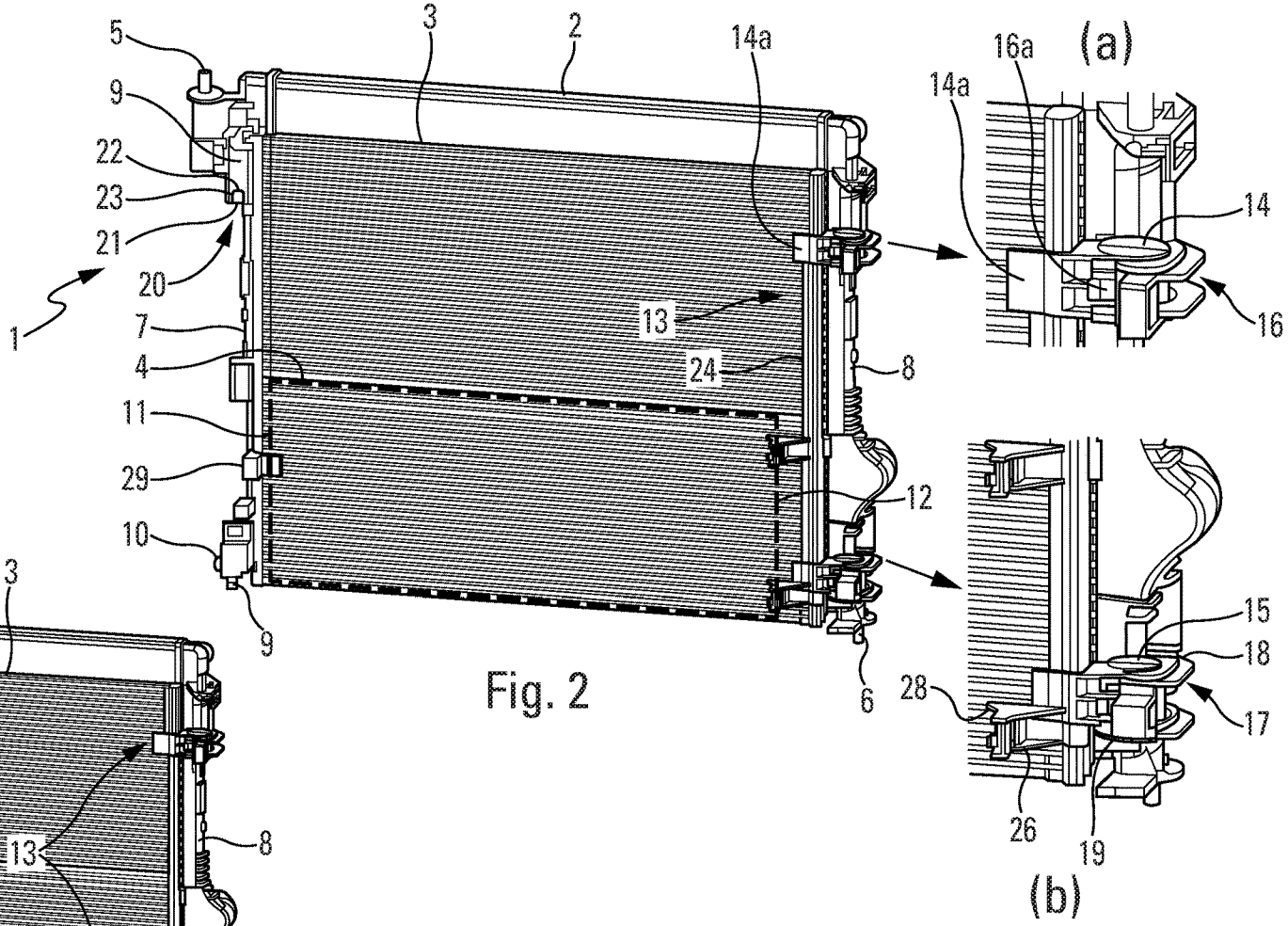

radiator (2) by means of a junction member (13) disposed between the main radiator (2) and at least one first auxiliary heat exchanger (3), The junction member (13) is principally formed of at least two shaft bearings (14, 15) attached to the first auxiliary heat exchanger (3) and nested inside respective open flanges (16, 17) formed on one of the lateral sides (7, 8) of the main radiator (2).
Secondarily, the junction member (13) carries a plurality of auxiliary heat exchangers (3, 4) fixed to one another in staggered succession and composing a thermal submodule mounted on the main radiator (2) by means of the junction member (13).

26 Claims, 2 Drawing Sheets

(51) Int. Cl.
*F28F 9/007* (2006.01)
*F28F 9/26* (2006.01)
*F28D 21/00* (2006.01)

(52) U.S. Cl.
CPC ..... *F28F 9/266* (2013.01); *F28D 2021/0084* (2013.01)

(58) Field of Classification Search
CPC ..... F28D 1/0435; F28D 2021/0091; F28D 2021/0089; B60H 1/00528; B60K 11/04
USPC ..... 180/68.4
See application file for complete search history.

(56) References Cited

U.S. PATENT DOCUMENTS

| | | | | |
|---|---|---|---|---|
| 6,199,622 | B1 * | 3/2001 | Mashio | B60K 11/04 165/149 |
| 6,202,737 | B1 * | 3/2001 | Mahe | F28D 1/0435 165/140 |
| 8,281,848 | B2 * | 10/2012 | Park | F28F 9/002 165/42 |
| 9,091,468 | B2 * | 7/2015 | Colpan | F25B 39/04 |
| 10,295,277 | B2 * | 5/2019 | Giordano | F28D 1/0435 |
| 2004/0069442 | A1 | 4/2004 | Yagi et al. | |
| 2016/0001629 | A1 * | 1/2016 | Rohr | B60H 1/00528 165/76 |

OTHER PUBLICATIONS

Written Opinion of the International Searching Authority issued in PCT/FR2017/050279 dated Sep. 27, 2017 (4 pages).
Second Office Action in corresponding Chinese Application No. 201780021291.4, dated Jun. 30, 2020 (11 pages).

* cited by examiner

DEVICE FOR ASSEMBLING A HEAT EXCHANGER OF AN AIR-CONDITIONING APPARATUS WITH A RADIATOR FOR COOLING THE ENGINE OF A MOTOR VEHICLE

The present invention lies in the field of heat exchange equipment for motor vehicles. The present invention more particularly concerns thermal modules that associate a cooling radiator of a motor vehicle engine and at least one heat exchanger that is part of a thermal equipment of the vehicle, in particular of an air-conditioning installation. The present invention relates more specifically to ways of mounting said at least one heat exchanger on said radiator.

In the automotive field, a ventilated radiator is routinely used to cool the engine of a motor vehicle. The radiator is mounted at the front of the vehicle and has a cooling fluid passed through it. The cooling fluid circulates between the engine and the radiator, to take up heat given off by the engine and to return that heat to the surrounding air following its admission into the radiator, which is cooled by ventilation.

It is also routine for a motor vehicle to be equipped with a ventilation, heating and/or air-conditioning installation. An installation of this kind has a coolant fluid fed through it, and essentially comprises a compressor, a condenser, a receiver drier, a pressure regulator and an evaporator. The compressor aspirates the coolant fluid in the gas state which is then fed to the condenser in the form of a gas at a high pressure and at a high temperature. The coolant fluid then changes from the gas state to the liquid state, giving off heat. The condenser is usually situated at the front of the vehicle, being coupled to a fan to favor heat exchange between the condenser and the outside air, leading to liquefaction of the coolant fluid. The receiver drier traps moisture contained in the circuit to prevent its deterioration. The pressure regulator is coupled with the evaporator to bring about the passage of the coolant fluid from the liquid state to the gas state.

In this context, it is known to mount the condenser equipped with the receiver drier on the radiator that is used for cooling the engine of the vehicle. The condenser is disposed with its general plane parallel to the general plane of the radiator, the receiver drier being attached to the condenser and being mounted on the radiator.

It is more specifically known to provide along one of the lateral sides of the radiator a cell to receive the receiver drier and flanges for retaining the receiver drier inside the cell. The flanges are disposed on the lateral side of the radiator and superposed at a distance depending on the height of the radiator. The receiver drier is then nested conjointly inside the flanges, a lower flange providing a base for supporting the bottom of the receiver drier by gravity. The bottom of the receiver drier is liable to include a hollow cooperating by nesting with the base to center it inside the cell. The flanges preferably include elastically deformable members that hold the receiver drier in position on the radiator.

Moreover, manufacturers may also be led to propose a range in which internal combustion engine vehicles are provided alongside hybrid vehicles. The latter are equipped with thermal modules in evaporator-condensers which differ from the condensers of internal combustion engines as described above in that they are not equipped with any receiver drier.

It is also known to mount one or more heat exchangers with no receiver drier on a radiator used for cooling the engine of the vehicle, notably in the case of application to diesel engine vehicles. Because of the absence of receiver driers attached to the heat exchangers, the radiator is then provided with particular mounting means to receive one or more of them. Such mounting means comprise in particular arms disposed in lateral engagement on the radiator and provided with attachment members specific to each of the heat exchangers. On this subject see for example the document U.S. Pat. No. 6,059,019 (MODINE MANUFACTURING COMPANY et al.).

It is therefore clear that the mounting means proposed for installing on the radiator heat exchangers with no receiver drier have the disadvantages of often being structurally complex and of having to be specifically adapted according to the structure of the heat exchangers.

In this context, the subject matter of the present invention is a thermal module for a motor vehicle, of the type comprising a radiator hereinafter termed the main radiator on which is mounted at least one heat exchanger, hereinafter termed the auxiliary heat exchanger. The main radiator is dedicated to cooling an engine of the vehicle and said at least one auxiliary heat exchanger participates in cooling a thermal equipment of the vehicle.

A thermal equipment of this kind is in particular a ventilation, heating and/or air-conditioning installation, or in other words an air-conditioning installation equipping the vehicle. A thermal equipment of this kind is again for example a system for cooling electric power members of the vehicle in the context in particular of use of the thermal module for an electric vehicle, which is driven by an electric motor alone, and/or in the context of a hybrid motor vehicle, which is driven by an electric motor and/or by a thermal engine.

The present invention more particularly aims to propose a mounting device between the main radiator and said at least one auxiliary heat exchanger that in particular enables a module to be obtained at lower cost, in particular by avoiding a complex arrangement of the mounting device involving substantial and/or structural adaptations of the main radiator and/or the auxiliary heat exchanger.

The arrangement of the mounting device also aims to be compatible to procure selectively the installation on the main radiator of one or more auxiliary heat exchangers with respective potentially diverse structures. It aims in particular to be able to equip both internal combustion engine vehicles and hybrid vehicles, avoiding significantly impacting the respective structural arrangements of the main radiator, of the auxiliary heat exchanger or exchangers and/or the mounting device.

The thermal module of the present invention for a motor vehicle comprises a main radiator and at least one auxiliary heat exchanger. As before, it is understood that the main radiator is dedicated to cooling an engine of the vehicle. It is also understood that the auxiliary heat exchanger is dedicated to cooling a thermal equipment of the vehicle, such as in particular an air-conditioning installation or a system for cooling electrical power members of the vehicle.

In this context, at least one auxiliary heat exchanger is mounted on the main radiator by means of a mounting device. The main radiator and said at least one auxiliary heat exchanger are conventionally disposed parallel to one another in the general plane in which they extend. The mounting device comprises in particular a junction member disposed between the main radiator and at least one first auxiliary heat exchanger. The junction member includes two shaft bearings fastened to the first auxiliary heat exchanger. Each shaft bearing is nested inside at least two open flanges provided on one of the lateral edges of the main radiator and in particular disposed at a distance from one another in the axial direction in which said axial body extends.

These dispositions are such that any so-called first auxiliary heat exchanger equipped with a junction member including said shaft bearings can be mounted on a known prior art main radiator. In this context, it is understood that such mounting can be obtained without having to provide said existing main radiator with specific arrangements for receiving the first auxiliary heat exchanger. An existing main radiator of this kind is in particular constituted of a main radiator on which is usually mounted a condenser provided with a receiver drier housed inside the flanges.

According to one feature of the invention, the shaft bearings may be extended by a lug configured to be engaged with a lateral end edge of the first heat exchanger.

It is proposed to immobilize the first auxiliary heat exchanger in both of the opposite axial directions in which the shaft bearings extend, advantageously employing for this purpose axial bearing engagement of the shaft bearings against at least one of the flanges. To this end, one or both shaft bearings include(s) at least one of two shoulders respectively bearing against at least one of the flanges in both opposite axial directions in which the shaft bearings extend.

In other words, two shoulders are advantageously and respectively formed on at least one of the shaft bearings, bearing axially against at least one of the flanges to oppose mobility of the first auxiliary heat exchanger on the main radiator in both opposite axial directions in which the shaft bearings extend. The resulting simple structural arrangement of at least one of the shaft bearings relative to said shoulders enables the first auxiliary heat exchanger to be retained on the main radiator in the heightwise direction in which it extends parallel to the axial direction in which the shaft bearings extend.

It is further proposed to immobilize the first auxiliary heat exchanger in both the opposite directions in which it extends laterally extending between its lateral edges. Remember that the flanges are open in the axial direction, such open flanges being advantageously employed to provide a passage for radial introduction of the shaft bearings inside the flanges to bring about their mutual nesting.

In this context, such immobilization is achievable by a removable and/or retractable member for closing the opening in the flanges. According to one embodiment, a closure member of this kind may be arranged as a flexible blade incorporated in at least one of the flanges. A flexible blade of this kind is able to flex out of the way to allow the passage of the shaft bearings into the flanges, and then spontaneously to resume its shape following the introduction of the shaft bearings into the flanges by forming an obstacle to prevent the shaft bearings escaping from the flanges.

To avoid a specific arrangement of the flanges, there is further proposed another embodiment in which the immobilization of the first auxiliary heat exchanger, in the direction in which it extends laterally, may be achieved by at least one of the shaft bearings constituting an elastically deformable member. For example, at least one of the shaft bearings may include an elastically deformable member immobilizing it inside the flange following elastic bearing engagement of the shaft bearing on the flange in the radial direction. To this end, at least one of said shoulders equipping the shaft bearing is for example formed by claws arranged at the free end of the flexible branches radially arranged at one axial end at least of the shaft bearing.

There could also be provided another solution whereby the first auxiliary heat exchanger includes a hook operating with at least one lug of the main radiator. The cooperation of the hook and the lug opposes mobility of the first auxiliary heat exchanger in both the opposite directions in which it extends laterally extending between its lateral edges. A lug of this kind may be formed by any element projecting from the main radiator, including an existing projecting element on the main radiator conforming to the present invention. According to one embodiment, said at least one hook is formed by a tongue attached to the first auxiliary heat exchanger on its lateral edge opposite that to which said at least one shaft bearing is fixed. The tongue includes for example at least one notch through it, the edges of which form said hook.

In this context and according to another aspect of the present invention, the junction member is employed to install on the main radiator a plurality of auxiliary heat exchangers disposed parallel and in staggered succession in a direction perpendicular to their general plane. Because of the fastening between the junction member and the first auxiliary heat exchanger, at least one second auxiliary heat exchanger may be installed on the first auxiliary heat exchanger.

More particularly, the junction member advantageously carries a thermal submodule comprising a set of auxiliary heat exchangers fixed to one another by means of the junction member in staggered succession in a direction perpendicular to their general plane. The junction member procures the mounting of a first auxiliary heat exchanger on the main radiator and of a second auxiliary heat exchanger on the first auxiliary heat exchanger.

More particularly, said thermal submodule comprises said at least one first auxiliary heat exchanger and at least one second auxiliary heat exchanger mounted on and parallel to the first auxiliary heat exchanger by means of a fixing means. Said fixing means is at least in part disposed between the junction member and the second auxiliary heat exchanger.

According to one embodiment, the fixing means comprises at least one cage formed on the junction member. Said at least one cage houses a tab equipping the second auxiliary heat exchanger on its lateral edge nearer the junction member. The fixing means preferably comprises at least two of said cages disposed at a distance from one another in a direction parallel to the axial direction in which said axial body extends, said cages housing respective tabs.

More particularly, said at least one cage advantageously constitutes a member for retaining the tab at least in an orientation parallel to the axial direction in which the shaft bearings extend and with an orientation perpendicular to the general plane of the second auxiliary heat exchanger.

Said at least one cage in particular provides bearing points for the tab retaining the second auxiliary heat exchanger in position on the first auxiliary heat exchanger. The second auxiliary heat exchanger is of course retained in its general plane parallel to the general plane of the first auxiliary heat exchanger.

The cage preferably also participates at least in part in retaining the second auxiliary heat exchanger in position in its general plane between its lateral edges. To this end according to one embodiment the cage is engaged on the lateral edge nearest the second auxiliary heat exchanger, to oppose mobility of the second auxiliary heat exchanger in at least one of the two opposite directions in which the second auxiliary heat exchanger extends laterally extending between its lateral edges.

The cage may be engaged on the lateral edge of the second auxiliary heat exchanger by hooking the cage onto the side and/or onto the edge surface of the lateral edge nearest the second auxiliary heat exchanger. Such hooking procures immobilization of the second auxiliary heat exchanger in both the opposite directions in which the second auxiliary heat exchanger extends extending between its lateral edges.

According to one embodiment, the fixing means comprises at least one stop formed on the first auxiliary heat exchanger on its lateral edge opposite that near the junction member. The stop is engaged on the nearest lateral side of the second auxiliary heat exchanger to oppose its mobility in at least one orientation perpendicular to the general plane of the second auxiliary heat exchanger. The stop is preferably removably or retractably mounted on the first auxiliary heat exchanger, to facilitate the installation of the second auxiliary heat exchanger on the first auxiliary heat exchanger. For example, the stop is mounted and reversibly fixed to the first auxiliary heat exchanger, such as by screwing and/or by elastic nesting.

The stop makes it possible to strengthen the retention of the second auxiliary heat exchanger parallel to the first auxiliary heat exchanger. Such strengthened retention complements retention procured otherwise by said at least one cage.

It is proposed to follow such an approach of cooperation between the cage and the stop to retain the second auxiliary heat exchanger in position on the first auxiliary heat exchanger. To this end there is proposed a specific embodiment whereby the cage and the stop conjointly bear antagonistically against the second auxiliary heat exchanger. Antagonistic bearing engagement of this kind opposes the mobility of the second auxiliary heat exchanger respectively in both of the two opposite directions in which it extends laterally between its lateral edges.

At least the cage, or even also the stop, preferably include(s) claws bearing against the edge surface of the lateral edges of the second auxiliary heat exchanger. Such bearing claws have in particular a conformation espousing the edge surface of the lateral edges of the second auxiliary heat exchanger against which the cage and the stop respectively bear. Dispositions of this kind make it possible to strengthen the antagonistic bearing engagement of the cage and the stop respectively against the second auxiliary heat exchanger.

According to one embodiment, the shaft bearings are each individually fixed, advantageously sealed, to the first auxiliary heat exchanger.

For example, the junction member may be of metal, such as a metal based on aluminum. In this case, the junction member may be welded, in particular brazed, to the metal body constituting the first auxiliary heat exchanger. For example, the junction member may be of plastic material. In this case, the junction member may be stuck to the first auxiliary heat exchanger. At least one of said fixing lugs may be provided with said at least one cage, interchangeably either directly or by means of a rod attached to at least one of the fixing lugs.

At least one of said fixing lugs can be provided with said at least one cage, equally well directly or via a rod fastened to at least one of the fixing lugs.

There is more specifically proposed an embodiment in which the shaft bearings are interconnected by a rod extending parallel to the axial direction in which the shaft bearings extend. The rod is for example attached, in particular sealed, at least to the shaft bearings, notably by means of the fixing lugs with which the shaft bearings are provided.

It is however preferable also to fasten the rod to the first auxiliary heat exchanger to strength the retention of the second auxiliary heat exchanger by the junction member. The rod may also be attached, sealed to the first auxiliary heat exchanger According to an advantageous embodiment, the rod is arranged as a slide nested over the nearer lateral edge of the first auxiliary heat exchanger. The space inside the slide is notably conformed according to the conformation of the edge surface of the lateral edge of the first auxiliary heat exchanger, onto which edge surface the slide is threaded, espousing its shape.

In this context, said at least one cage is advantageously formed on the rod, being part of the junction member. The cage is for example mounted on and sealed to the rod. For example, the junction member being made from a plastic material, the cage is integrally molded with the rod.

In an accessory manner, the cage may be mounted on the rod by means of a means for adjusting its position along the rod. Such adjustment means makes it possible to position the cage along the rod in a position suitable for retaining the second auxiliary heat exchanger as a function of its specific configuration.

The first auxiliary heat exchanger could be connected to fluid circulation pipes at its lateral end opposite the end in contact with the junction member.

According to various applications of the thermal module of the invention, the first auxiliary heat exchanger could be an equipment of an air-conditioning installation equipping the motor vehicle, and in particular be an evaporator-condenser. In this case in particular, the second auxiliary heat exchanger could be configured to participate in cooling the electrical power members employed by an electrical propulsion drive of the motor vehicle.

The thermal module of the present invention has a simple structural arrangement selectively enabling rapid and easy installation by an operative of one or more of said auxiliary heat exchangers. This kind of selective installation of the auxiliary heat exchanger or exchangers on the main radiator is in particular chosen when using the existing structure of a main radiator, in particular a dedicated one in accordance with the prior art, to receive a condenser provided with a receiver drier.

The structure of the junction member is simple, being potentially limited to said two shaft bearings fixed to the first auxiliary heat exchanger and nested inside the flanges equipping the main radiator. The ways of mounting the first auxiliary heat exchanger on the main radiator by means of the junction member according to the present invention enable use of the junction member to achieve rapid and easy mounting of the second auxiliary heat exchanger on the main radiator.

The structural additions specifically formed on the auxiliary heat exchanger or exchangers for their installation on the main radiator are limited. Easy selective mounting of the auxiliary heat exchanger or exchangers by an operative is achieved. Actually, where the first auxiliary heat exchanger is concerned, such structural additions are limited to the addition of said shaft bearings fixed to the first auxiliary heat exchanger, in a subsidiary manner completed by the addition of the rod and/or of the hook. Such additions also comprise in an accessory manner the stop removably mounted on the first auxiliary heat exchanger by means of a reversible fixing member.

Where the second auxiliary heat exchanger is concerned, such structural additions are potentially limited to the addition of the tabs.

The particular features of a method according to the present invention will therefore be appreciated, achieving the assembly of a thermal module as just described. According to a method of this kind, the first auxiliary heat exchanger is mounted on the main radiator by nesting the shaft bearings inside said flanges.

More particularly, the first auxiliary heat exchanger is mounted on the main radiator by simultaneous nesting of the shaft bearings inside the respective flanges. The nesting of the shaft bearings inside the flanges is notably effected by sliding the first auxiliary heat exchanger essentially parallel to the main radiator. In a subsidiary manner, following the nesting of the shaft bearings inside the flanges, slight tilting of the first auxiliary heat exchanger at its lateral edge equipped with the junction member brings about the engagement of the hook on the main radiator.

Moreover the second auxiliary heat exchanger is mounted on the first auxiliary heat exchanger at least by means of the junction member. The second auxiliary heat exchanger is in particular mounted on the first auxiliary heat exchanger by nesting said at least one tab inside said at least one cage. The nesting of the tab inside the cage is in particular effected by sliding the second auxiliary heat exchanger essentially parallel to the first auxiliary heat exchanger. In a subsidiary manner, following the nesting of the tab inside the cage, the removable stop is fixed to the first auxiliary heat exchanger, by screwing it and/or by elastically nesting it.

It is to be noted that the second auxiliary heat exchanger may be mounted on the first auxiliary heat exchanger interchangeably before or after installing the first auxiliary heat exchanger on the main radiator.

The assembly of one or more auxiliary heat exchangers and an existing main radiator provided with said flanges may be easily and selectively achieved by the use of the dispositions provided by the present invention. An assembly of this kind can be effected without structural modification of a prior art main radiator of this kind, by employing the flanges respectively receiving said shaft bearings that are part of the junction member, potentially carrying a plurality of auxiliary heat exchangers.

Figure 1:
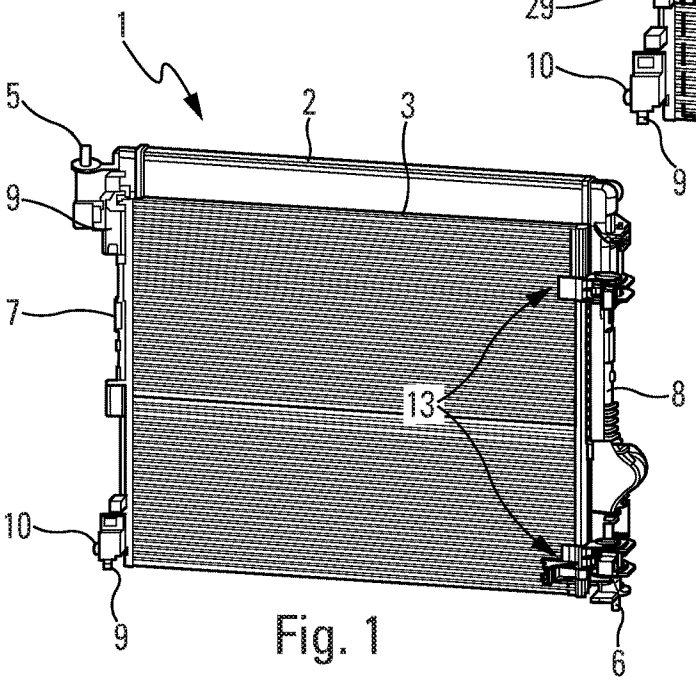
Figure 3:
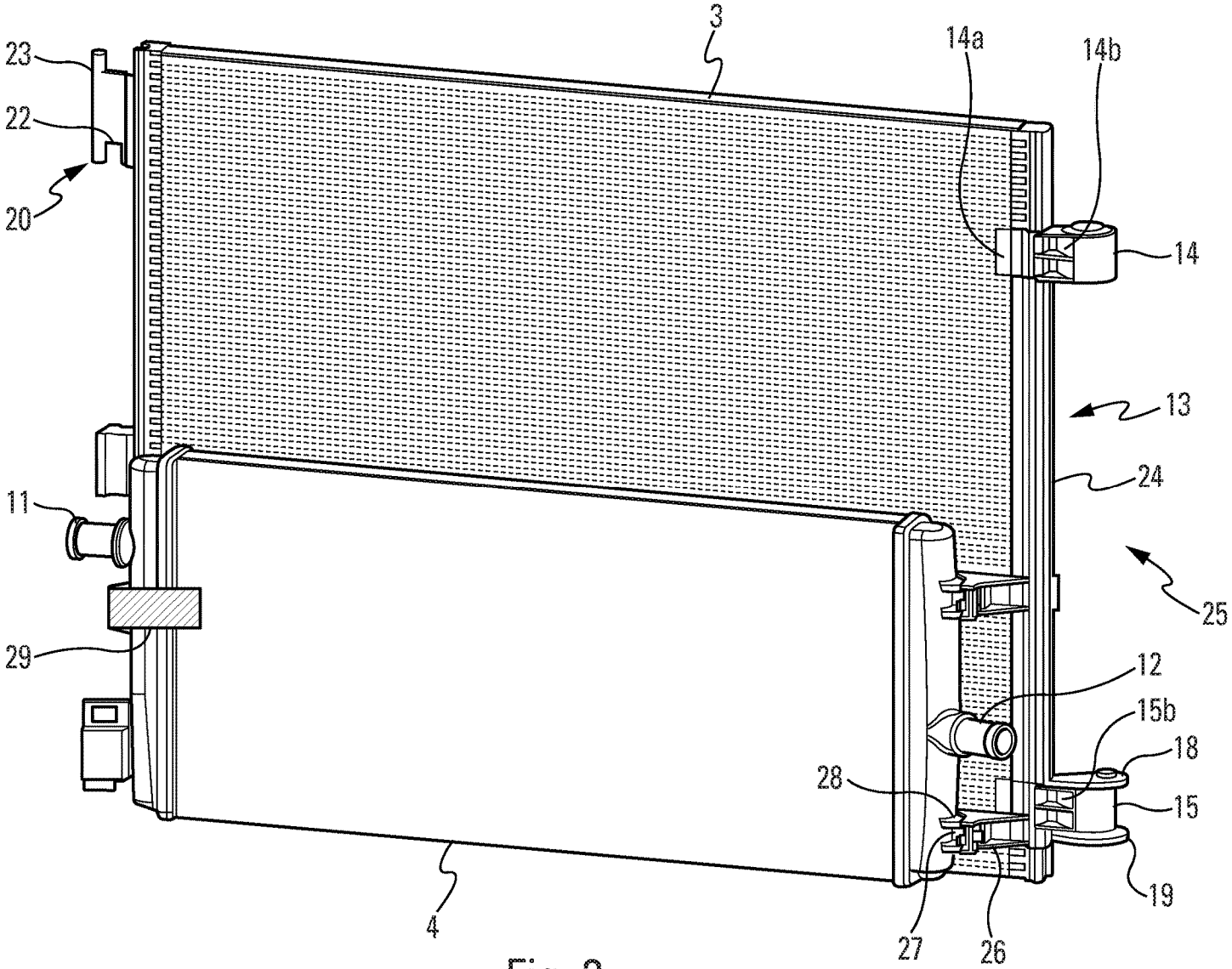

Other features, details and advantages of the present invention will emerge more clearly on reading the following detailed description given by way of illustration, relating to the embodiments of the invention shown in the figures of the appended drawings, in which drawings:

FIG. 1 is a front view of a thermal module according to a first embodiment of the present invention, FIG. 2 is a front view of a thermal module according to a second embodiment of the present invention, FIG. 3 is a front view of a thermal submodule equipping the thermal module shown in FIG. 2.

It should first be noted that the figures are used to explain the present invention in detail and in accordance with particular embodiments thereof. Said figures and their description can of course serve if necessary to define the present invention better, both in general and in particular.

Moreover to clarify and to facilitate the reading of the description to be given of embodiments of the present invention, the common members represented in the various figures are respectively identified in the descriptions specific to those figures by the same reference numbers and/or letters, without involving their individual representation in each of the figures and/or an identical arrangement of said common members between specific embodiments.

Referring to FIG. 1 and FIG. 2, a thermal module 1 is intended to be mounted on a motor vehicle, selectively to equip a system for cooling functional members of the motor vehicle. The thermal module 1 comprises a plurality of heat exchangers 2, 3 or 4 that are globally flat and disposed parallel to one another in their general plane. The heat exchangers 2, 3 or 4 comprise a main radiator 2 and one or more auxiliary heat exchangers 3, 4.

The geometrical references of the heat exchangers 2, 3, 4 the general planes of which are each defined by their height H oriented perpendicularly to their width L that extends between two lateral edges are specified here and now. Thus the thickness E of the heat exchangers 2, 3, 4 is oriented perpendicularly to their general plane. To specify the disposition of the heat exchanges 2, 3, 4 on the vehicle, the latter are shown frontally at the front of the vehicle, their thickness E being oriented along the longitudinal axis along which the vehicle concerned extends between the front and the rear of the vehicle.

The main radiator 2 is typically assigned to cooling an engine of the vehicle. To this end, the main radiator 2 conventionally incorporates a heat exchange fluid circulation path and is equipped with end-pieces 5, 6 for respectively connecting it to an inlet pipe and to an outlet pipe for fluid. Such end-pieces 5, 6 are respectively provided on the one and the other of the lateral edges 7, 8 of the main radiator.

The auxiliary heat exchanger or exchangers 3, 4 is or are part of auxiliary cooling systems of the vehicle. The auxiliary heat exchangers also each incorporate a heat exchange fluid circulation path and are individually equipped with end-pieces 9, 10 and 11, 12 for respectively connecting them to an inlet pipe and to an outlet pipe for the fluid that are assigned to them.

A first auxiliary heat exchanger 3 is for example part of an installation for air-conditioning the passenger compartment of the vehicle. It should be noted here and now that the end-pieces 9, 10 that equip the first auxiliary heat exchanger 3 are conjointly disposed on one of its lateral edges, opposite that by means of which the first auxiliary heat exchanger 3 is mounted on the main radiator 2. Actually, the first auxiliary heat exchanger 3 is mounted on the main radiator 2 by means of a junction member 13 occupying one of its lateral edges.

Referring to FIG. 2 and FIG. 3, a second auxiliary heat exchanger 4 is for example part of a system for cooling the electrical power members equipping the vehicle. A cooling system of this kind only equips motor vehicles in which propulsion is at least in part provided by an electric motor, such as a hybrid vehicle or an electric vehicle.

In FIG. 3, the end-pieces 11, 12 equipping the second auxiliary heat exchanger 4 are respectively provided at the one and the other of its lateral edges. The second auxiliary heat exchanger 4 is mounted on the first auxiliary heat exchanger 3 in staggered succession in the direction of their thickness E, by means of the junction member 13 attached to the first auxiliary heat exchanger 3 on one of its lateral edges. The first auxiliary heat exchanger 3 is therefore disposed in the middle of the stack comprising the main radiator and the two heat exchangers.

In all the figures the junction member 13 is attached to the first auxiliary heat exchanger 3 on one of its lateral edges. The junction member 13 is adapted to be placed between the first auxiliary heat exchanger 3 and the main radiator 2, as shown in FIG. 1 and FIG. 2. The junction member 13 fixed to the first auxiliary heat exchanger 3 is then more particularly mounted by nesting it over the lateral edge 8 of the main radiator 2. The nesting of the junction member 13 on the main radiator 2 procures the installation of the first auxiliary heat exchanger 3 parallel to the main radiator 2.

Referring in particular to the details (a) and (b) of FIG. 2 and to FIG. 3, the junction member 13 comprises to this end at least two shaft bearings 14, 15 fixed, sealed to the first auxiliary heat exchanger 3 by. The shaft bearings 14, 15 are for example each provided with a fixing lug 14*a*, 15*a* for attaching them to the first auxiliary heat exchanger 3. The shaft bearings 14, 15 cooperate with radially open flanges 16, 17 attached to the lateral edge 8 of the main radiator 2, being placed at a distance from one another in the direction of their axial orientation or in other words parallel to the height H of the main radiator 2.

The shaft bearings 14, 15 are inserted inside the flanges 16, 17 by nesting them therein with an orientation essentially parallel to the respective general planes of the main radiator 2 and the first auxiliary heat exchanger 3. The flanges 16, 17 feature flexible tongues 16*a* adapted to be spread apart to allow the shaft bearings to pass to the interior of the corresponding flange, these flexible tongues being able to revert to their original shape to be housed in notches 14*b*, 15*b* formed on the shaft bearings (visible in FIG. 3).

At least one shaft bearing 15 in question includes at least one shoulder 18, 19 bearing axially, that is to say here in the direction of the height H, on a face of the corresponding flange. Afterwards, the first auxiliary heat exchanger 3 is retained on the main radiator 2 in the direction of its height H or in other words according to the axial orientation along which the shaft bearings 14, 15 extend.

The first auxiliary heat exchanger 3 is installed on the main radiator 2 by laterally sliding the first auxiliary heat exchanger 3 in its general plane, in a direction essentially oriented in the direction of its width L. Said lateral sliding causes the shaft bearings 14, 15 to cooperate with the flanges 16, 17 and in a subsidiary manner is completed at the end of travel by slight tilting of the first auxiliary heat exchanger 3 at its lateral edge engaged on the junction member 13. Tilting of this kind aims to dispose the first auxiliary heat exchanger 3 parallel to the main radiator 2 following the nesting of the shaft bearings 14, 15 inside the flanges 16, 17.

Moreover, referring to FIG. 2, tilting of this kind enables a hook 20 attached to the first auxiliary heat exchanger 3 to be engaged with a lug 21 attached to the main radiator 2. The hook 20 is formed by a notch 22 formed through a tongue 23 attached to the first auxiliary heat exchanger 3 on its lateral edge opposite that to which the junction member 13 is fixed. The hook 20 is engaged on the lug 21 so that the first auxiliary heat exchanger 3 is immobilized on the main radiator 2 with an orientation parallel to the direction in which they extend laterally. This cooperation of the hook 20 and the lug 21 enables fixing of the position of the first auxiliary heat exchanger 3, it being understood that fixing by the junction member 13 alone could suffice, because of the clipping of the shaft bearings in the eyelets and retention by the elastic tongues, and the presence of the shoulders forming an abutment.

In all the figures, the shaft bearings 14, 15 are individually fixed, sealed to the first auxiliary heat exchangers 3 by means of respective fixing lugs 14*a*, 15*a*. In the embodiment shown in FIG. 2 and FIG. 3, the shaft bearings 14, 15 are moreover interconnected by a rod 24 that is part of the junction member 13. A rod 24 of this kind is advantageously employed to facilitate the mounting the shaft bearings in the eyelets by simultaneous insertion of the shaft bearings by manipulating only the rod 24. A rod of this kind moreover participates in the installation of the second auxiliary heat exchanger 4 on the first auxiliary heat exchanger 3 by means of the junction member 13.

The first auxiliary heat exchanger 3 and the second auxiliary heat exchanger 4 are more particularly interconnected by the junction member 13, constituting a thermal submodule 25. The second auxiliary heat exchanger 4 is mounted on the first auxiliary heat exchanger 3 in staggered succession in the direction of their thickness E, by means of the junction member 13 attached to the first auxiliary heat exchanger 3. A thermal submodule 25 of this kind can be mounted on the main radiator 2 by means of the junction member 13 so that, as already described hereinabove, the stack consists in the succession of the main radiator, the first auxiliary heat exchanger and the second auxiliary heat exchanger.

A fixing means is at least in part disposed between the junction member 13 and the second auxiliary heat exchanger 4. The fixing means comprises one or more cages 26 fixed to the junction member 13 and each housing a tab 27 equipping the second auxiliary heat exchanger 4. The cages 26 are disposed at a distance from one another on the rod 24 to which the cages 26 are fixed. The cages 26 are attached, sealed to the junction member 13 or molded during the formation of the junction member.

The cages 26 house the tabs 27 and immobilize the second auxiliary heat exchanger 4 on the first auxiliary heat exchanger 3 with an orientation parallel to their height H and with an orientation parallel to their thickness E.

The cages 26 include claws 28 that bear against the nearest lateral edge of the second auxiliary heat exchanger 4. Moreover, the fixing means also comprises at least one stop 29 formed on the first auxiliary heat exchanger 3 on its lateral edge opposite that to which the fixing member 13 is fixed and the cage or cages 26 forming the fixing means is or are fixed. The stop 29 is for example fixed to the first auxiliary heat exchanger 3 by reversible fixing means, such as by screwing and/or by elastic nesting. The cages 26 and the stop 29 bear antagonistically against the second auxiliary heat exchanger 4, conjointly bringing about its retention in position in the direction of its width on the first auxiliary heat exchanger 3.

The second auxiliary heat exchanger 4 is mounted on the first auxiliary heat exchanger 3 essentially by laterally sliding the second auxiliary heat exchanger 4 in its general plane, in a direction essentially oriented in the direction of its width L. Said lateral sliding brings about the introduction of the tabs 27 inside the cages 26 and the bearing of the cages 26 against the lateral edge of the second auxiliary heat exchanger 4 by means of the claws 28 with which the cages 26 are equipped. The stop 29 is then placed against the second auxiliary heat exchanger 4, by fixing it onto the first auxiliary heat exchanger 3, such as by screwing it on for example.

The invention claimed is:

1. A thermal module for a motor vehicle, comprising:

a main radiator; and a set of auxiliary heat exchangers mounted on the main radiator by a mounting device, the mounting device comprising a junction member disposed between the main radiator and a first auxiliary heat exchanger of the set of auxiliary heat exchangers, wherein the junction member includes at least two shaft bearings attached to the first auxiliary heat exchanger and configured to cooperate with at least two open flanges provided on one of the lateral sides of the main radiator, wherein the main radiator and each auxiliary heat exchanger of the set of auxiliary heat exchangers are fixed to one another by the junction member in staggered succession in a direction perpendicular to their general plane, and wherein the main radiator and each auxiliary heat exchanger of the set of auxiliary heat exchangers have different heights that are successively decreasing in the staggered succession.

2. The thermal module as claimed in claim 1, wherein the shaft bearings are extended by a lug configured to be interengaged with a lateral end edge of the first auxiliary heat exchanger.

3. The thermal module as claimed in claim 1, wherein said two flanges are disposed at a distance from one another with the axial orientation in which said junction member extends.

4. The thermal module as claimed in claim 1, wherein the shaft bearings are retained inside respective flanges by elastic clipping.

5. The thermal module as claimed in claim 4, wherein at least one of said flanges includes a flexible tongue for closing an opening that said flanges include.

6. The thermal module as claimed in claim 5, wherein said flexible tongue is configured to deform elastically to allow the shaft bearings to enter the flanges and to resume its shape spontaneously after introduction of the shaft bearings into the flanges.

7. The thermal module as claimed in claim 1, wherein two shoulders respectively formed on at least one of the shaft bearings bear axially against at least one of the flanges, opposing mobility of the first auxiliary heat exchanger on the main radiator in both of the two opposite axial directions in which the shaft bearings extend.

8. The thermal module as claimed in claim 1, wherein the first auxiliary heat exchanger includes a hook cooperating with at least one lug of the main radiator to oppose mobility of the first auxiliary heat exchanger in both of the opposite directions in which the first auxiliary heat exchanger extends laterally extending between its lateral edges.

9. The thermal module as claimed in claim 1, wherein the junction member carries a thermal submodule comprising the set of auxiliary heat exchangers.

10. The thermal module as claimed in claim 9, wherein the junction member procures the mounting of the first auxiliary heat exchanger on the main radiator and the mounting of a second auxiliary heat exchanger on the first auxiliary heat exchanger.

11. The thermal module as claimed in claim 10, wherein the thermal submodule comprises said first auxiliary heat exchanger and at least one second auxiliary heat exchanger mounted on and parallel to the first auxiliary heat exchanger by a fixing means at least in part disposed between the junction member and the second auxiliary heat exchanger.

12. The thermal module as claimed in claim 11, wherein the fixing means comprises at least one cage formed on the junction member and housing a tab equipping the second auxiliary heat exchanger at its lateral edge nearer the junction member.

13. The thermal module as claimed in claim 12, wherein the cage constitutes a member for retaining the tab at least in accordance with an orientation parallel to the axial direction in which the shaft bearings extend and an orientation perpendicular to the general plane of the second auxiliary heat exchanger.

14. The thermal module as claimed in claim 12, wherein the cage is interengaged with the nearer lateral edge of the second auxiliary heat exchanger to oppose mobility of the second auxiliary heat exchanger in at least one of the two directions in which the second auxiliary heat exchanger extends laterally extending between its lateral edges.

15. The thermal module as claimed in claim 12, wherein the fixing means comprises at least one stop provided on the first auxiliary heat exchanger at its lateral edge opposite that close to the junction member, the stop being interengaged with the nearer lateral edge of the second auxiliary heat exchanger to oppose its mobility with at least one orientation perpendicular to the general plane of the second auxiliary heat exchanger.

16. The thermal module as claimed in claim 15, wherein the stop is mounted on and reversibly fixed to the first auxiliary heat exchanger.

17. The thermal module as claimed in claim 15, wherein the cage and the stop are conjointly in antagonistic bearing engagement against the second auxiliary heat exchanger, opposing its mobility respectively in both of the two opposite directions in which the second auxiliary heat exchanger extends laterally extending between its lateral edges.

18. The thermal module as claimed in claim 1, wherein the shaft bearings are each individually fixed to the first auxiliary heat exchanger.

19. The thermal module as claimed in claim 2, wherein the shaft bearings are interconnected by a rod extending parallel to the axial direction in which the shaft bearings extend.

20. The thermal module as claimed in claim 19, wherein the rod and the lug or lugs (lip) form a one-piece assembly.

21. The thermal module as claimed in claim 19, wherein the rod is a slide nested over the nearer lateral edge of the first auxiliary heat exchanger.

22. The thermal module as claimed in claim 19, further comprising at least one cage formed on the junction member and housing a tab equipping the second auxiliary heat exchanger at its lateral edge nearer the junction member, and wherein said at least one cage is formed on the rod.

23. The thermal module as claimed in claim 1, wherein the first auxiliary heat exchanger is connected to fluid circulation pipes at a lateral edge opposite the edge in contact with the junction member.

24. The thermal module as claimed in claim 10, wherein the first auxiliary heat exchanger is an equipment of an air-conditioning installation equipping the motor vehicle.

25. The thermal module as claimed in claim 24, wherein the first auxiliary heat exchanger is an evaporator-condenser.

26. The thermal module as claimed in claim 24, wherein the second auxiliary heat exchanger is configured to participate in cooling electrical power members used by an electrical propulsion drive of the motor vehicle.

* * * * *